US008884173B2

(12) United States Patent
Chou

(10) Patent No.: US 8,884,173 B2
(45) Date of Patent: Nov. 11, 2014

(54) ILLUMINATED KEYCAP FOR GENERATING SOFT LIGHT

(71) Applicant: Zippy Technology Corp., New Taipei (TW)

(72) Inventor: Chin-Wen Chou, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 139 days.

(21) Appl. No.: 13/731,980

(22) Filed: Dec. 31, 2012

(65) Prior Publication Data

US 2014/0183018 A1 Jul. 3, 2014

(51) Int. Cl.
*H01H 9/26* (2006.01)
*H01H 13/83* (2006.01)

(52) U.S. Cl.
CPC ..... *H01H 13/83* (2013.01)
USPC ..... 200/5 A

(58) Field of Classification Search
USPC ..... 200/310–314, 317, 5 A, 512–521, 200/344–345; 362/556, 554, 555, 558, 559, 362/616, 26, 27
See application file for complete search history.

(56) References Cited

U.S. PATENT DOCUMENTS

| | | | | |
|---|---|---|---|---|
| 6,860,612 | B2 * | 3/2005 | Chiang et al. | 362/29 |
| 8,502,094 | B2 * | 8/2013 | Chen | 200/5 A |
| 2013/0306455 | A1 * | 11/2013 | Wang et al. | 200/5 A |
| 2014/0118264 | A1 * | 5/2014 | Leong et al. | 345/168 |

FOREIGN PATENT DOCUMENTS

| | | |
|---|---|---|
| CN | 202258936 U | 5/2012 |
| TW | M405001 U | 6/2011 |

* cited by examiner

*Primary Examiner* — Edwin A. Leon
(74) *Attorney, Agent, or Firm* — Muncy, Geissler, Olds & Lowe, P.C.

(57) ABSTRACT

An illuminated keycap for generating soft light is located in a keyboard which includes a command circuit board located beneath the keycap and a lighting unit to project light to the keycap. The keycap includes a press surface, a connecting section extended from the press surface towards the command circuit board and a color display surface extended from the connecting section and parallel to the press surface. The press surface, connecting section and color display surface form a light retaining zone. The press surface has a top surface coated with a first pigment layer. The color display surface has a bottom surface coated with a second pigment layer whose color is different from the first pigment layer. The first and second pigment layers form a mixed color so that light generated by the lighting unit to enter the light retaining zone is emitted softly through the connecting section.

11 Claims, 5 Drawing Sheets

ILLUMINATED KEYCAP FOR GENERATING SOFT LIGHT

FIELD OF THE INVENTION

The present invention relates to an illuminated keycap and particularly to an illuminated keycap capable of generating soft light.

BACKGROUND OF THE INVENTION

Design of an illuminated keyboard solves the problem of being unable to clearly identify characters and notations on the keycaps in a dark environment by computer users. The design mainly focuses on improvements in light transmission structure and keycap structure in the keyboard. Compared with the light transmission structure, the keycap structure is easier in improvement. The keycap in a conventional illuminated keyboard usually has a light mask layer coated on the press surface thereof and a plurality of transparent zones on the light mask layer to allow light to pass through. The transparent zones usually are a character or notation to enable users to identify in the dark environment.

R.O.C. patent No. M405001 discloses an illuminated keycap which comprises a casing stuffing layer, a base color layer, a notation layer, a light emitting layer and a protective layer. The casing stuffing layer contains a stuffing material. The base color layer covers the upper surface of the casing stuffing layer. The notation layer covers the base color layer. The light emitting layer contains light emitting material and covers the base color layer and contacts the notation layer directly. The protective layer covers the upper surface of the casing stuffing layer and can be made of a transparent material. The light emitting layer contains at least one type of light emitting material, such as fluorescent or phosphorous material which can absorb light and energy thereof to excite electrons from a ground state to an excited state, and radiate energy in the form of light, thus the light can illuminate the notations in the notation layer for a prolonged period of time. However, as the base color layer is monochromatic and looks dull and humdrum, and the light emitted directly through the top surface of the keycap is too strong, users are difficult to identify the individual keycaps and easy to make errors when entering characters or commands that result in repetitive input entry. After being used for a prolonged period of time, users' eyes easily feel fatigue or even cause vision injury if the users try very hard to identify the notations on the keycaps.

In order to increase diversity of the keyboard, China patent No. CN 202258936U provides a dual-color keycap. It includes a cap body formed via plastic injection and a coated layer on the outer wall of the cap body and in a color different from the cap body. The dual-color keycap thus formed provides a multi-layer visual feeling. But its coated layer is formed by spraying. Thus the top surface of the cap body has to be covered prior to spraying. Moreover, the color sprayed on the coated layer is different from the cap body, hence spraying is a tedious and time-consuming that increases the production cost and is not economic. There are still rooms for improvement.

SUMMARY OF THE INVENTION

The primary object of the present invention is to solve the problems of the conventional illuminated keycaps that emit too strong light to make users identify individual keycaps difficult, and have to be made by spraying two different colors to result in time consumption and high cost.

To achieve the foregoing object, the present invention provides an illuminated keycap that generates soft light. It is located in a keyboard which includes a command circuit board located beneath the keycap and triggered by a vertical movement of the keycap to issue a keyboard command signal. The keyboard also has at least one lighting unit located inside to provide light and project the light to the keycap. The keycap includes a press surface, a transparent connecting section extended from the press surface towards the command circuit board and a color display surface extended from the connecting section and parallel to the press surface. The press surface, connecting section and color display surface jointly form a light retaining zone in the keycap. The press surface has a top surface coated with a first pigment layer. The color display surface has a bottom surface coated with a second pigment layer whose color is different from that of the first pigment layer. The first and second pigment layers form a mixed color so that light generated by the lighting unit to enter the light retaining zone is emitted softly through the connecting section.

In one embodiment the keycap is made of a transparent material.

In another embodiment the keycap is made of a translucent material.

In yet another embodiment the first pigment layer is opaque.

In yet another embodiment the second pigment layer is opaque.

In yet another embodiment the first pigment layer has a transparent portion corresponding to a location on the keycap where a character notation is formed.

In yet another embodiment the character notation is a transparent third pigment layer.

In yet another embodiment the first pigment layer is coated onto the top surface of the press surface via screen printing.

In yet another embodiment the second pigment layer is coated onto the bottom surface of the color display surface via screen printing.

In yet another embodiment the keyboard includes a plurality of keycaps, and the first pigment layers on the abutting keycaps are different in color.

In yet another embodiment the keyboard includes a plurality of keycaps, and the second pigment layers on the abutting keycaps are different in color.

The invention, compared with the conventional techniques, provides many advantages, notably:

1. The keycap can be coated with varying colors via screen printing. Compared with the conventional keycap coated by two colors by spraying, the invention is simpler and easier, takes less time and costs lower.

2. Through the first pigment layer on the top surface of the press surface and second pigment layer on the bottom surface of the color display surface of the keycap, light from the lighting unit can project into the light retaining zone and be emitted softly through the connecting section. Hence users can use the keyboard more comfortably in a dark environment. Moreover, through the transparent third pigment layer, the character notation on the keycap can be further identified clearly.

3. The abutting keycaps on the keyboard can be formed in different colors, thereby make the illuminated keyboard more colorful. Incorporated with the lighting units also generating different colors of light, color diversity is further enhanced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
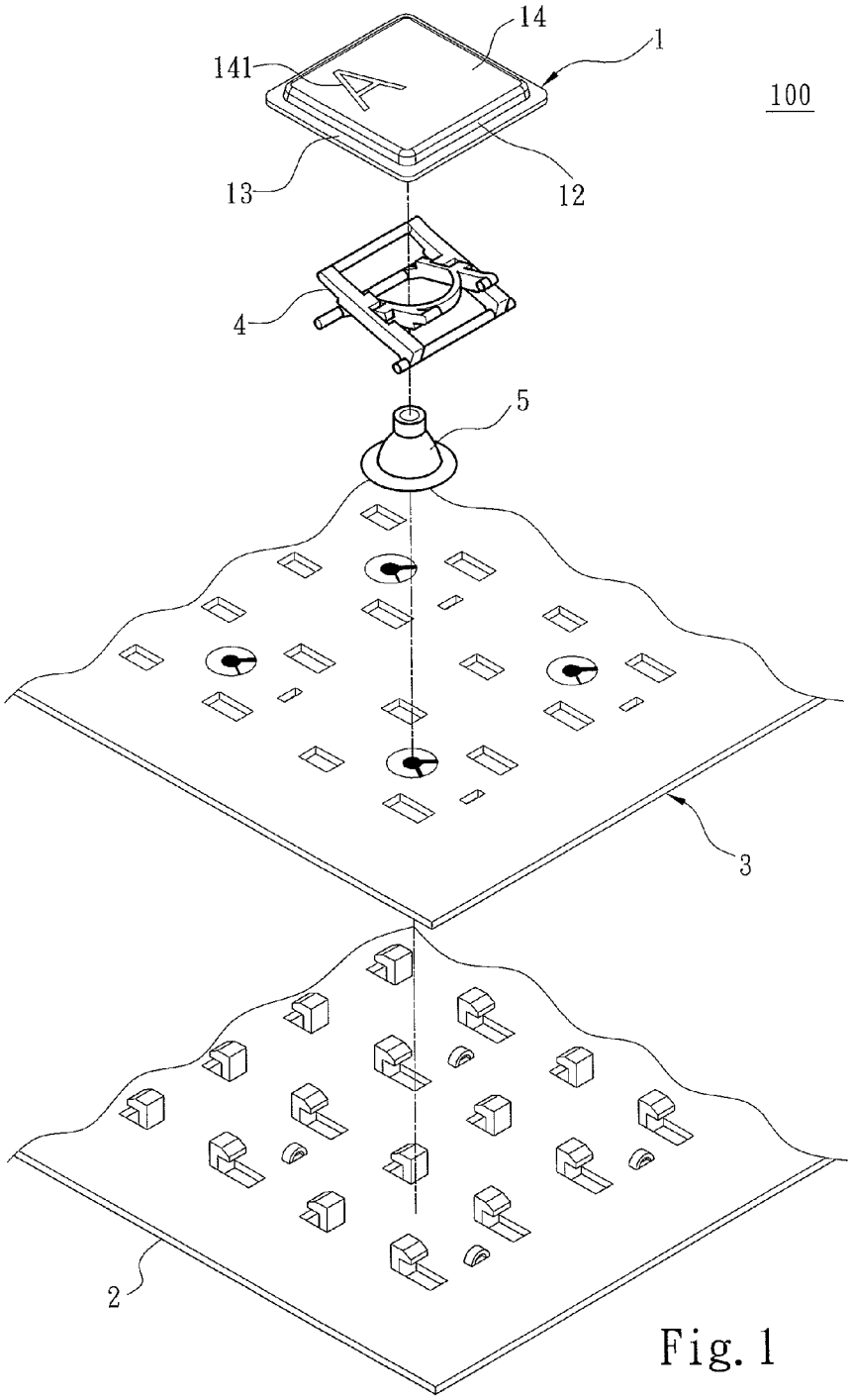
FIG. 1 is an exploded view of an embodiment of the keyboard of the invention.
Figure 4:
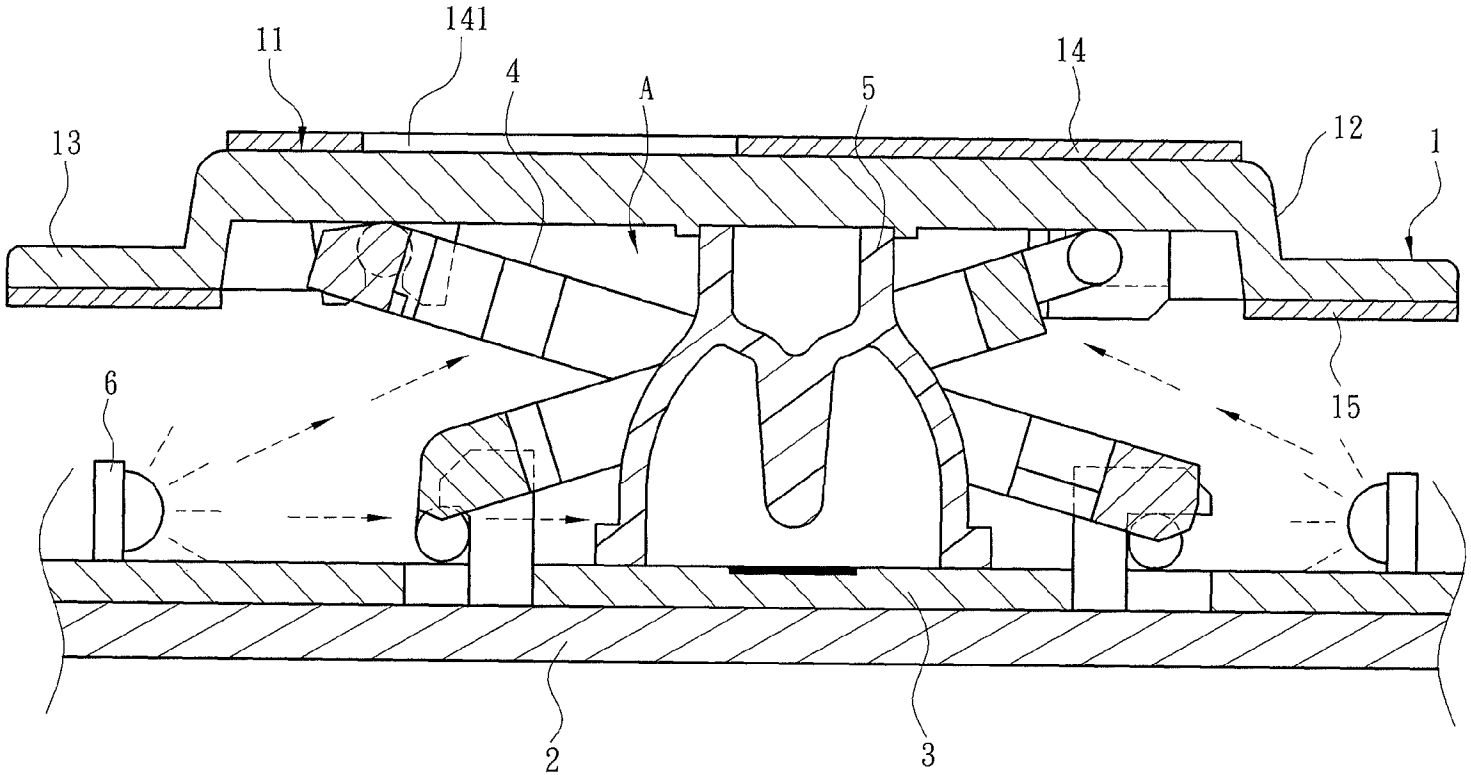
FIG. 4 is a cross section of an embodiment of the keyboard of the invention.
Figure 5:
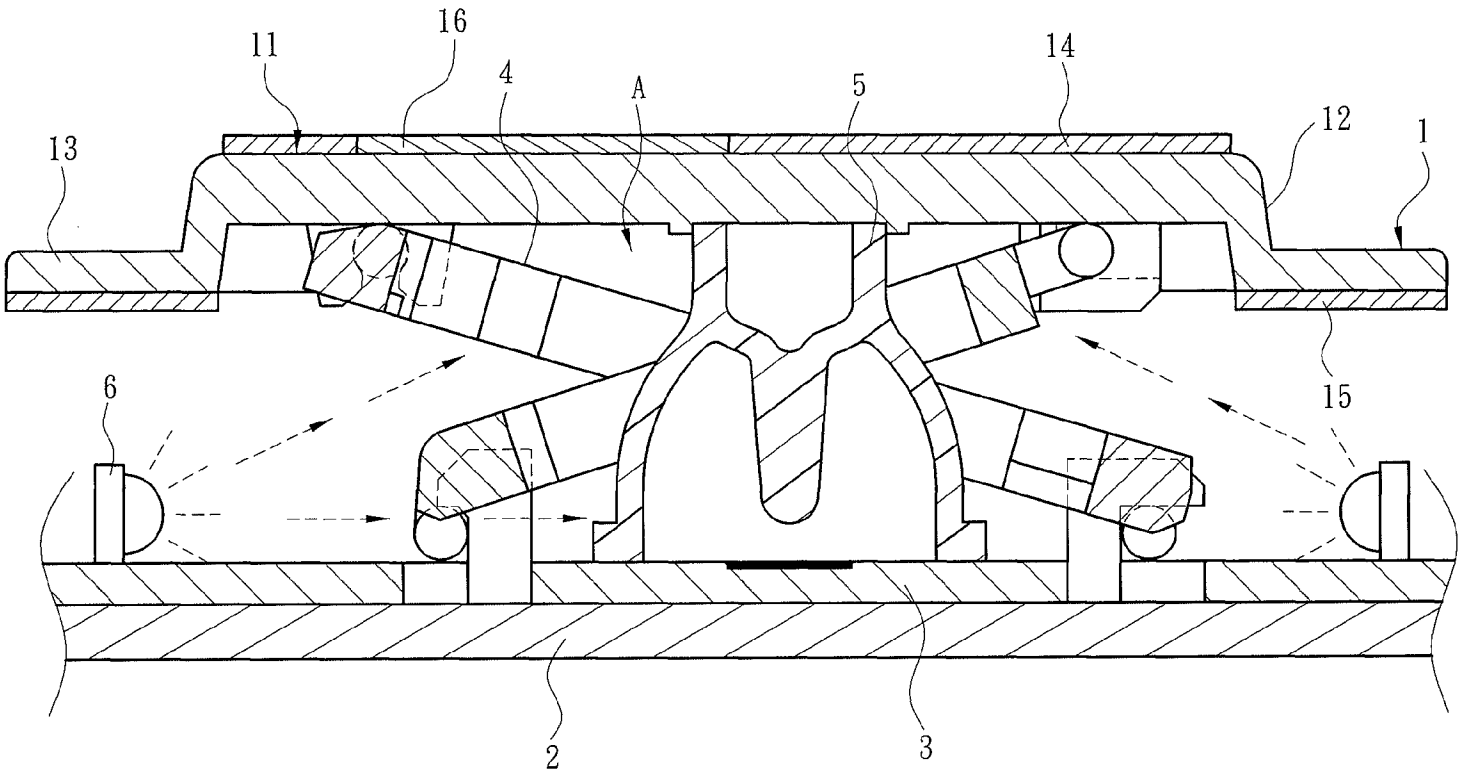
FIG. 5 is a cross section of another embodiment of the keyboard of the invention.

Please refer to FIG. 1 for an embodiment of the keyboard according to the invention. The invention aims to provide an illuminated keycap 1 for generating soft light. It is located in a keyboard 100 which includes a baseboard 2 to hold the keycap 1, a command circuit board 3 located on the baseboard 2, a driven mechanism 4 to bridge the baseboard 2 and keycap 1, an elastic element 5 located in the driven mechanism 4 to allow the keycap 1 to move vertically against the command circuit board 3 to generate a keyboard command signal, and a lighting unit 6 (shown in FIG. 4) to provide light to project to the keycap 1. The invention does not limit light emission mode of the lighting unit 6. For instance, the lighting unit 6 can be located between two rows of neighboring keycaps 1, or between the baseboard 2 and keycap 1, or below the baseboard 2 to provide the light for the keycap 1.

Figure 2A:
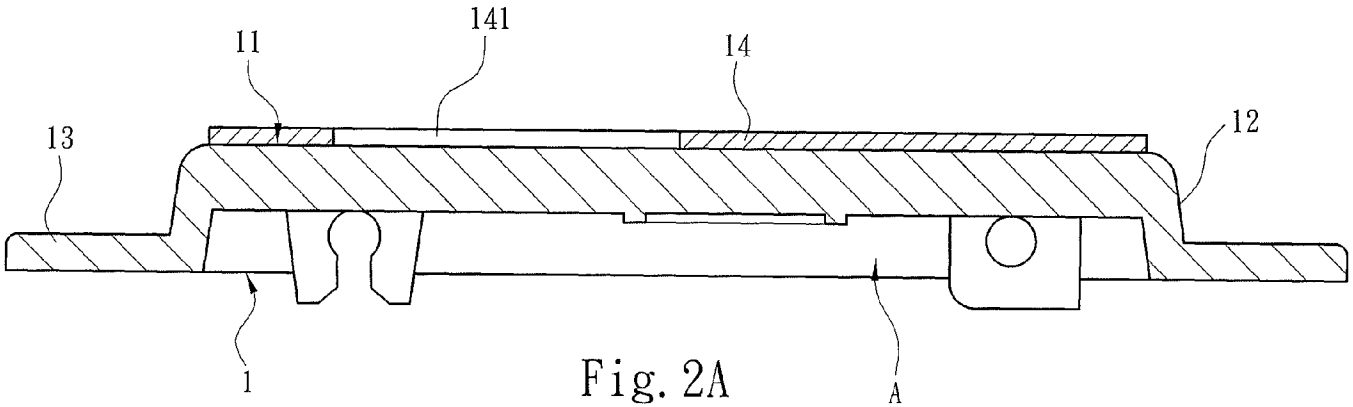
FIG. 2A is a schematic view of an embodiment of the invention showing coating of a first pigment layer.
Figure 2B:
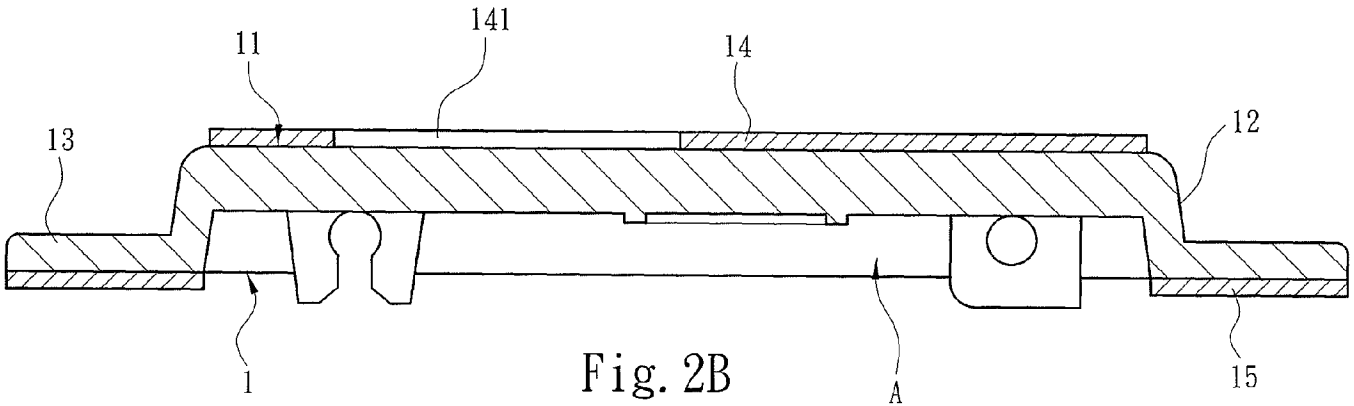
FIG. 2B is a schematic view of an embodiment of the invention showing coating of a second pigment layer.

Please refer to FIGS. 1, 2A and 2B. More specifically, the keycap 1 can be made of a transparent material or a translucent material, and includes a press surface 11, a transparent connecting section 12 extended from the press surface 11 towards the command circuit board 3 and a color display surface 13 extended from the connecting section 12 and parallel to the press surface 11. The press surface 11, connecting section 12 and color display surface 13 jointly form a light retaining zone A in the keycap 1. The press surface 11 has a top surface coated with a first pigment layer 14 through screen printing. The color display surface 13 has a bottom surface coated with a second pigment layer 15 whose color is different from that of the first pigment layer 14. When the lighting unit 6 projects light to the keycap 1, the first pigment layer 14 and second pigment layer 15 form a mixed color so that the light generated by the lighting unit 6 to enter the light retaining zone A is emitted softly through the connecting section 12. More specifically, the first pigment layer 14 and the second pigment layer 15 are opaque. The first pigment layer 14 has a transparent portion 141 not covering the press surface 11 and corresponding to a location on the keycap 1 where a character notation is formed. When the light from the lighting unit 6 projects to the keycap 1, the light is emitted through the transparent portion 141 and the connecting section 12 to become soft light, so that the keycap 1 can provide a colorful and soft light. Hence users can use the keyboard 100 more comfortably in a dark environment and also can clearly identify the character notation on the keycap 1.

Figure 3A:
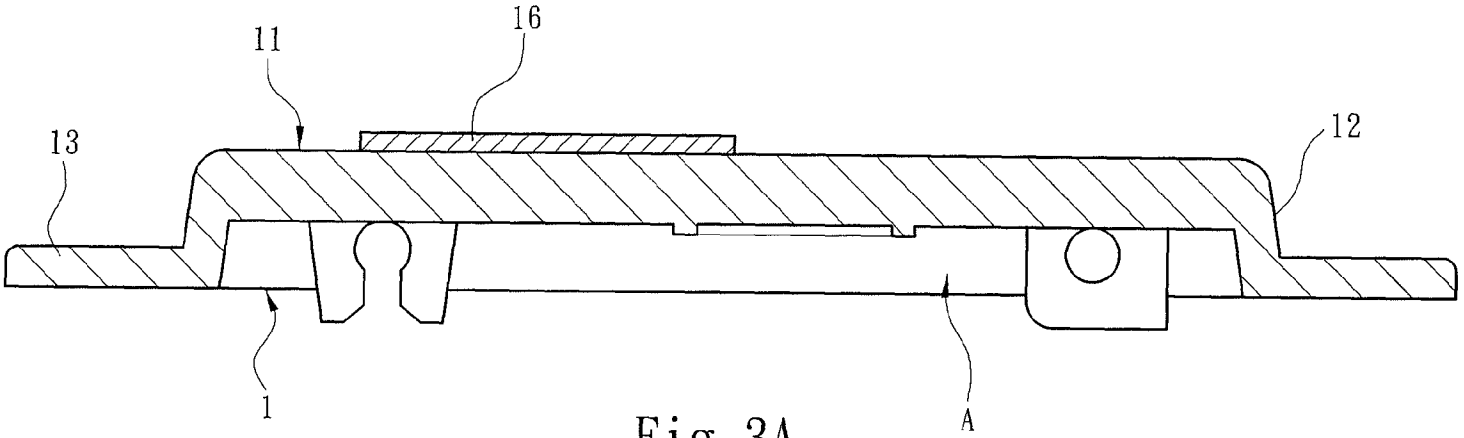
FIG. 3A is a schematic view of another embodiment of the invention showing coating of a third pigment layer.
Figure 3B:
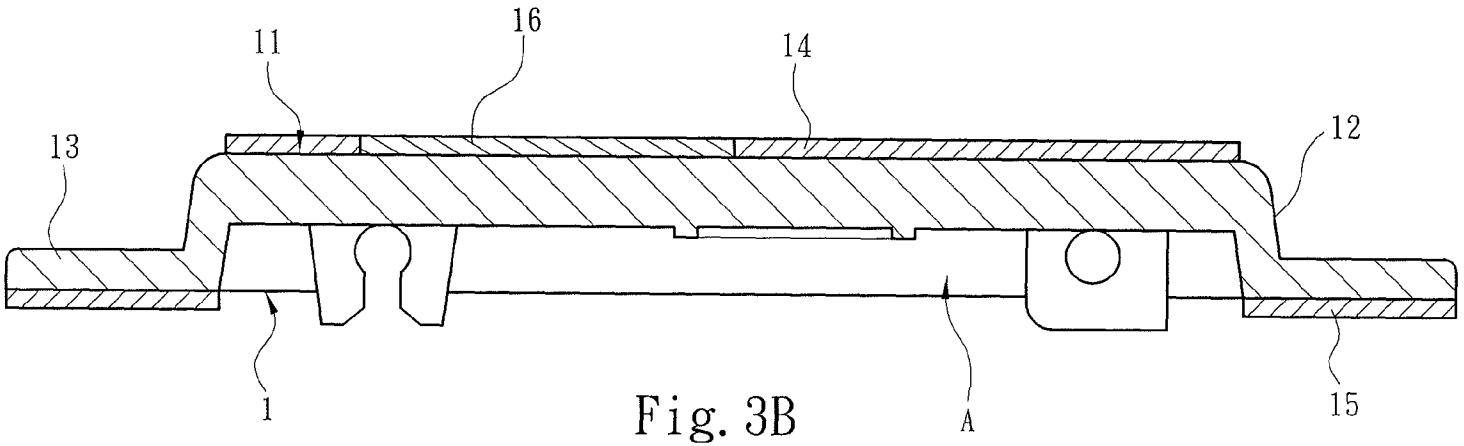
FIG. 3B is a schematic view of another embodiment of the invention showing coating of first and second pigment layers.

Please refer to FIGS. 3A and 3B for another embodiment of the invention. In order to provide more abundant visual feeling, the character notation can be a transparent third pigment layer 16. More specifically, the transparent third pigment layer 16 is coated first on the top surface of the press surface 11 via screen printing; then the opaque first pigment layer 14 is coated on the top surface of the press surface 11. The first pigment layer 14 and third pigment layer 16 are different in color. The transparent portion 141 is formed via screen printing to correspond to and expose the third pigment layer 16 so that the character notation is formed in a color different from that of the first pigment layer 14. Finally, the second pigment layer 15 is coated onto the bottom surface of the color display surface 13 to complete fabrication of the keycap 1.

Please refer to FIGS. 1, 3A, 3B, 4 and 5. When the lighting unit 6 projects light to the keycap 1, the light enters the light retaining zone A. Through the first pigment layer 14 and second pigment layer 15, a first light color and a second light color are generated. The first light color and second light color form a mixed color which is emitted softly through the connecting section 12 (referring to FIG. 4). The press surface 11 further can be coated with the third pigment layer 16 to generate a third light color which is also incorporated with the mixed color of the first and second color light to be emitted softly through the connecting section 12. Thus users not only can clearly identify the character notation on the keycap 1, but also get more abundant visual feeling. In addition, as the keyboard 100 of the invention includes a plurality of keycaps 1, the first pigment layers 14 on abutting keycaps 1 can be formed in different colors, and the second pigment layers 15 on the abutting keycaps 1 also can be formed in different colors. Hence when the lighting unit 6 projects light to different keycaps 1, the keyboard 100 can emit the soft light with diversified colors. Even the lighting unit 6 can provide different changeable light colors as desired, thereby the soft light emitted from the keycap 1 on the keyboard 100 can be more diversified.

As a conclusion, the keycap of the invention can be coated simply in various colors through screen printing. Compared with the conventional technique of forming two colors on the keycap by spraying, the invention is more time-consuming and costs less. Moreover, by forming the first pigment layer on the top surface of the press surface and second pigment layer on the bottom surface of the color display surface of the keycap, light from the lighting unit projected to the light retaining zone can be emitted softly through the connecting section. Hence users can use the keyboard more comfortably in a dark environment. Through the transparent third pigment layer, the character notation on the keycap also can be clearly identified. Furthermore, as the keycaps on the keyboard can be coated with different colors and incorporated with multiple lighting units generating varying light colors, the keyboard can provide soft and diversified color effect. Thus it provides significant improvements over the conventional techniques.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An illuminated keycap for generating soft light located in a keyboard which includes a command circuit board located beneath the keycap and triggered by a vertical movement of the keycap to issue a keyboard command signal, and at least one lighting unit located inside to provide light projecting to the keycap, comprising:

a press surface, a transparent connecting section extended from the press surface towards the command circuit board and a color display surface extended from the connecting section and parallel to the press surface; the press surface, the connecting section and the color display surface jointly forming a light retaining zone in the keycap, the press surface including a top surface coated with a first pigment layer, the color display surface including a bottom surface coated with a second pigment layer whose color is different from that of the first pigment layer, the first pigment layer and the second pigment layer forming a mixed color such that the light generated by the lighting unit to enter the light retaining zone is emitted softly through the connecting section.

2. The illuminated keycap for generating the soft light of claim 1 further being made of a transparent material.

3. The illuminated keycap for generating the soft light of claim 1 further being made of a translucent material.

4. The illuminated keycap for generating the soft light of claim 1, wherein the first pigment layer is opaque.

5. The illuminated keycap for generating the soft light of claim 1, wherein the second pigment layer is opaque.

6. The illuminated keycap for generating the soft light of claim 1, wherein the first pigment layer includes a transparent portion corresponding to a location on the keycap where a character notation is formed.

7. The illuminated keycap for generating the soft light of claim 6, wherein the character notation is a transparent third pigment layer.

8. The illuminated keycap for generating the soft light of claim 1, wherein the first pigment layer is coated onto the top surface of the press surface through screen printing.

9. The illuminated keycap for generating the soft light of claim 1, wherein the second pigment layer is coated onto the bottom surface of the color display surface through screen printing.

10. The illuminated keycap for generating the soft light of claim 1, wherein the keyboard includes a plurality of keycaps, the first pigment layers on the abutting keycaps are different in color.

11. The illuminated keycap for generating the soft light of claim 1, wherein the keyboard includes a plurality of keycaps, the second pigment layers on the abutting keycaps are different in color.

* * * * *